United States Patent [19]

Marks et al.

[11] Patent Number: 5,030,881

[45] Date of Patent: Jul. 9, 1991

[54] COLOR PICTURE TUBE WITH SHADOW MASK HAVING IMPROVED APERTURE BORDER

[75] Inventors: Bruce G. Marks, Lancaster; Thomas D. Welles, Jr., York, both of Pa.

[73] Assignee: RCA Licensing Corporation, Princeton, N.J.

[21] Appl. No.: 547,003

[22] Filed: Jul. 2, 1990

[51] Int. Cl.[5] ..... H01J 29/07

[52] U.S. Cl. ..... 313/403; 313/408

[58] Field of Search ..... 313/403, 408

[56] References Cited

U.S. PATENT DOCUMENTS

| | | | |
|---|---|---|---|
| 4,227,115 | 10/1980 | Eishof et al. | 313/403 |
| 4,293,791 | 10/1981 | D'Amato | 313/403 |
| 4,300,070 | 11/1981 | Godfrey et al. | 313/403 |

*Primary Examiner*—Donald J. Yusko
*Assistant Examiner*—Ashok Patel
*Attorney, Agent, or Firm*—Joseph S. Tripoli; Dennis H. Irlbeck

[57] ABSTRACT

An improved color picture tube includes a mask that has an aperture array including slit-shaped apertures aligned in columns that essentially parallel the minor axis and end at a border of the aperture array. Adjacent apertures in each column are separated by tie bars in the mask. The tie bars in one column are offset in the longitudinal direction, paralleling the minor axis, from the tie bars in each adjacent column. The spacing between tie bars in a column is the tie bar pitch at a location on the mask. A first set of columns, that includes every other column, has increased tie bar pitch at the ultimate end apertures, as compared to the tie bar pitch at the penultimate apertures in each of the columns. In a second set of columns, every other column not in the first set, has decreased tie bar pitch at the ultimate end apertures, as compared to the tie bar pitch at the penultimate apertures in each of the columns. The last tie bars before the ends of the aperture columns in the second set are shorter than the next to the last tie bars, measured in the longitudinal direction of the columns, and the ultimate apertures at the ends of all of the aperture columns end on a smooth border line.

1 Claim, 3 Drawing Sheets

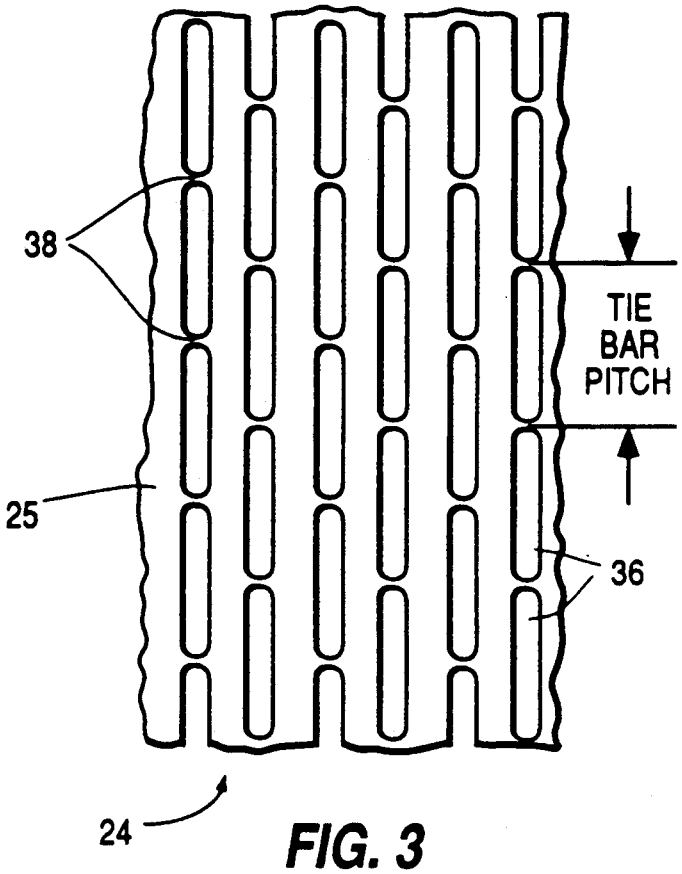
FIG. 3
FIG. 5
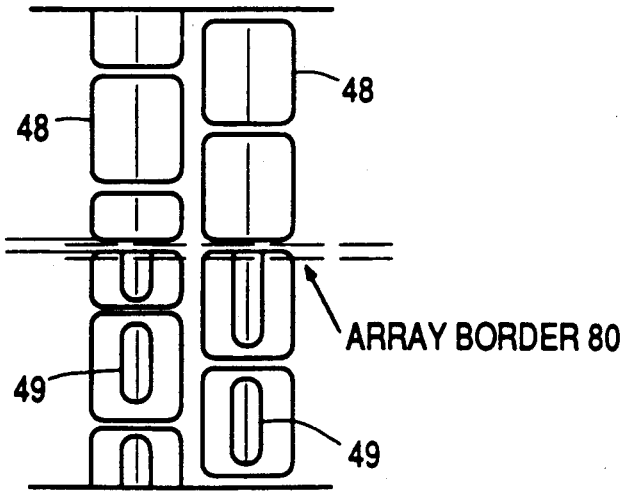

COLOR PICTURE TUBE WITH SHADOW MASK HAVING IMPROVED APERTURE BORDER

This invention relates to color picture tubes of a type having shadow masks with slit-shaped apertures, wherein the apertures are aligned in columns and the apertures in each column are separated by tie bars in the mask, and particularly to a method of making such a mask which achieves a smooth border on the apertured portion of the mask.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars are essential in a the mask, to maintain its integrity when it is formed into a dome-shaped contour which somewhat parallels the contour of the interior of a viewing faceplate of a tube. Tie bars in one column are offset in the longitudinal direction of the column (vertical direction) from the tie bars in the immediately adjacent columns. Because of the pattern of apertures and tie bars, the upper and lower borders of the aperture array are somewhat jagged. Some aperture columns end with tie bars near the border, while other columns end with apertures at the border. When a viewing screen is formed using the mask as a photomaster, the resultant screen also has jagged upper and lower borders. Such jagged borders are esthetically undesirable.

One solution that produces screens with smooth borders is disclosed in U.S. Patent No. 4,300,070, issued to R. H. Godfrey et al. on Nov. 10, 1981. In that patent, the aperture array border is smoothed with a complicated method of lengthening and shortening the pitches of the last two apertures in each column. The method not only made the border geometry smooth, but also equalized the light output at the edges of the screen. Such method was developed for use with masks having a constant tie bar pitch and a projected straight line border on the screen.

Recently, attempts have been made to produce shadow masks wherein the tie bar vertical repeat, or tie bar pitch, is varied. The object of the variation is to produce a constant pitch shadow on the screen to reduce the problem of moire. If the top and bottom borders of the screens of tubes using these masks with varied tie bar pitch are to remain a straight line projections, there is a need for a new border smoothing technique which can be done simply for these masks.

SUMMARY OF THE INVENTION

An improved color picture tube has a shadow mask mounted therein. The mask has a rectangular periphery with two long sides and two short sides, a major axis which passes through the center of said mask and parallels the long sides, and a minor axis which passes through the center of the mask and parallels the short sides. The mask has an aperture array including slit-shaped apertures aligned in columns that essentially parallel the minor axis and end at a border of the aperture array. Adjacent apertures in each column are separated by tie bars in the mask. The tie bars in one column are offset in the longitudinal direction, paralleling the minor axis, from the tie bars in each adjacent column.

The spacing between tie bars in a column is the tie bar pitch at a location on the mask. The improvement comprises a first set of columns, comprising every other column, having increased tie bar pitch at the ultimate end apertures, as compared to the tie bar pitch at the penultimate apertures in each of the columns. A second set of columns, comprising every other column not in the first set, has decreased tie bar pitch at the ultimate end apertures, as compared to the tie bar pitch at the penultimate apertures in each of the columns. The last tie bars before the ends of the aperture columns in the second set are shorter than the next to the last tie bars, measured in the longitudinal direction of the columns, and the ultimate apertures at the ends of all of the aperture columns end on a smooth border line.

BRIEF DESCRIPTION OF THE DRAWINGS

FIG. 3 is an enlarged view of a small portion of a shadow mask of the tube of FIG. 1.

FIG. 5 is a plan view of the aperture patterns used on both sides of a mask.

DETAILED DESCRIPTION OF THE PREFERRED EMBODIMENTS

Figure 1:
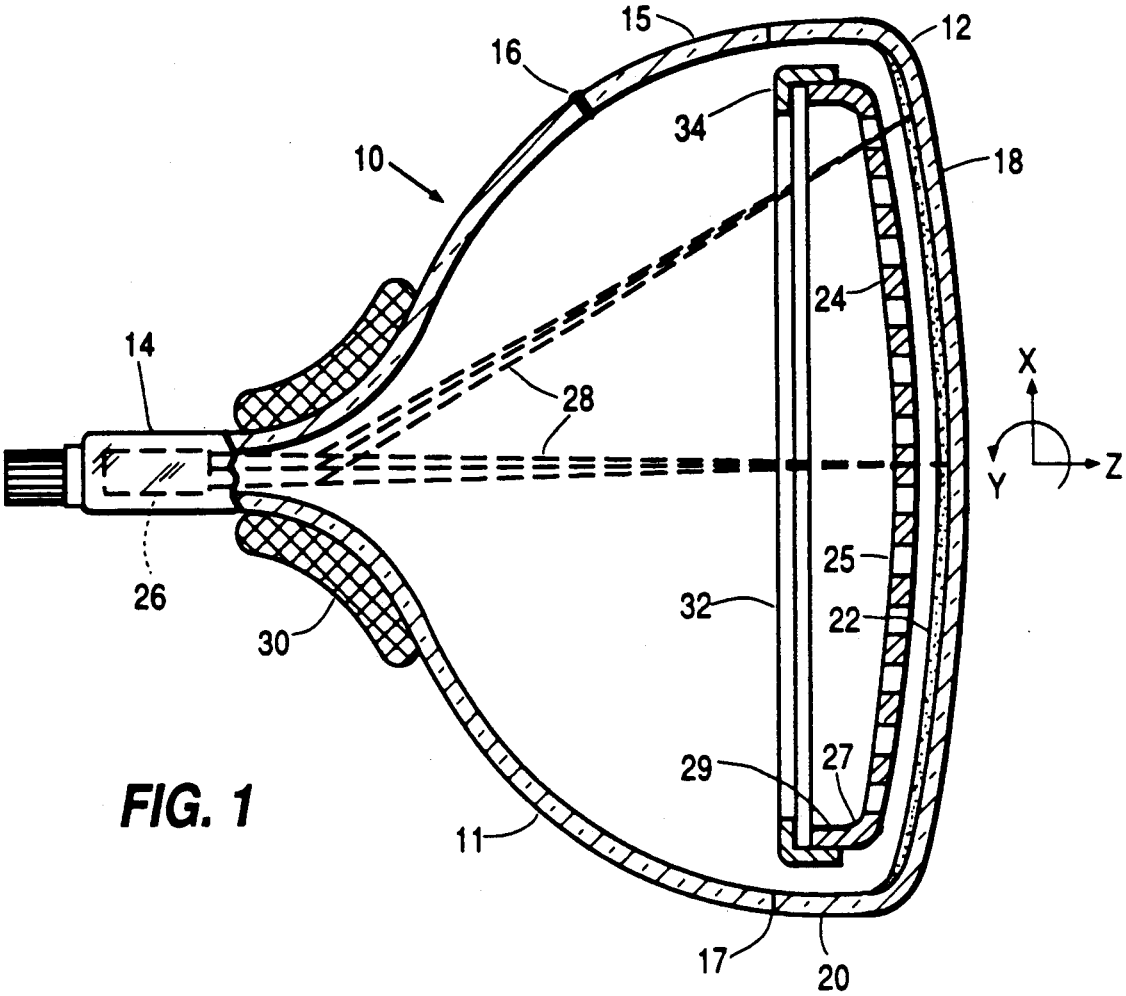
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen, with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1, and it is shown in front view in FIG. 2. The shadow mask 24 includes a curved apertured portion 25, an imperforate edge portion 27 surrounding the apertured portion 25, and a skirt portion 29 bent back from the edge portion 27 and extending away from the screen 22. The mask 24 is telescoped within the frame 34, and the skirt portion 29 is welded to the frame 34.

Figure 2:
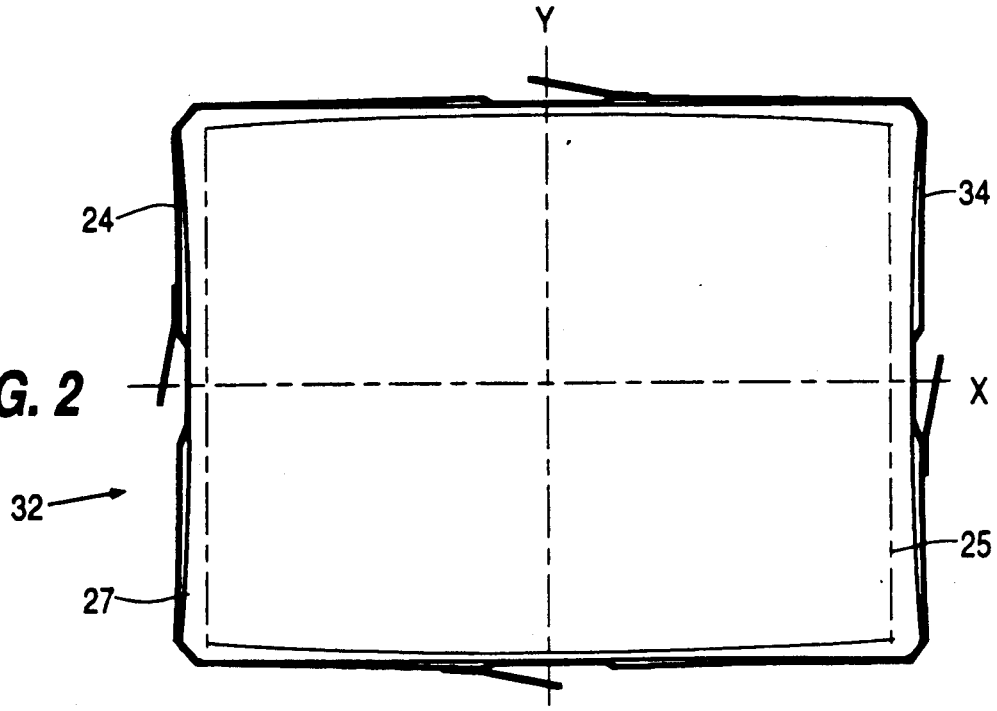
FIG. 2 is rear plan view of a mask-frame assembly of the tube of FIG. 1.

The shadow mask 24, shown in greater detail in FIGS. 2 and 3, has a rectangular periphery with two long sides and two short sides. The mask 24 has a major axis X, which passes through the center of the mask and parallels the long sides, and a minor axis Y, which passes through the center of the mask and parallels the short sides. The mask 24 includes slit-shaped apertures 36 aligned in columns that essentially parallel the minor axis Y. Adjacent apertures 36 in each column are separated by tie bars 38 in the mask, with the spacing between adjacent tie bars 38 in a column being defined as the tie bar pitch at a particular location on the mask, as shown in FIG. 3.

Figure 4:
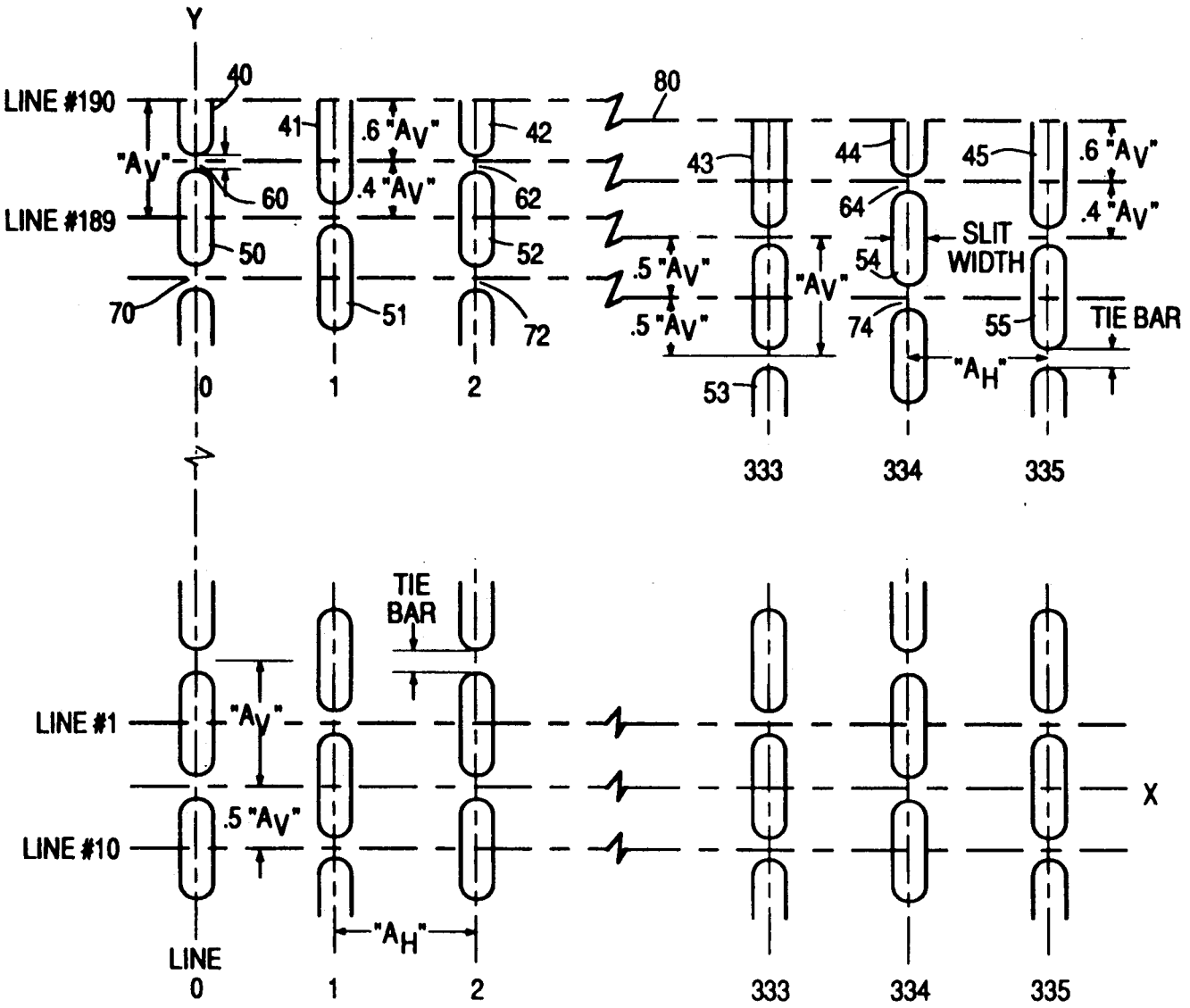
FIG. 4 is a composite view of a shadow mask showing the aperture and tie bar patterns in four locations in a quadrant of the mask.

FIG. 4 shows four areas of an upper right quadrant of the improved shadow mask 24. The four areas are: at the center of the mask at the intersection of the major axis X and the minor axis Y; at the top-center of the mask at the end of the minor axis Y; at the right-center side of the mask at the end of the major axis X; and at the upper right corner of the mask. In FIG. 4, the aperture pattern at upper right corner of the mask is slightly lower than the aperture pattern at the top-center because of a slight curvature in the top border of the apertured portion 25 of the mask as shown in FIG. 2. In the apertured portion of the mask, a first set of columns, comprising the odd numbered columns 1, 333 and 335, have ultimate end apertures 41, 43 and 45 of increased length, as compared to the length of the penultimate apertures 51, 53 and 55, respectively, in each of the columns. A second set of columns, comprising the even numbered columns 0, 2 and 334, have decreased tie bar pitch at the ultimate end apertures 40, 42 and 44, as compared to the tie bar pitch at the penultimate apertures 50, 52 and 54, respectively, in each of the columns. The last tie bars 60, 62 and 64 before the ends of the aperture columns in the second set are shorter than the next to the last tie bars thereof 70, 72 and 74, respectively, measured in the longitudinal direction of the columns, and the ultimate apertures at the ends of all of the aperture columns end on a smooth border line 80. Comparing this improved pattern of apertures and tie bars at the aperture array borders with the regular pattern without the improvement shows that the ultimate apertures 41, 43 and 45 in the odd numbered columns have been lengthened to extend to the array border 80, and the penultimate apertures 50, 52 and 54 in the even numbered columns have been shortened. The purpose of lengthening the ultimate apertures in the odd numbered columns is to eliminate any tie bars that would be near the array border. Often, a small partial aperture near a border will not etch through during mask etching, thereby leaving an undesirable step or discontinuity in the border. Because a tie bar is eliminated from the odd columns near the array border, compensation must be made in the even numbered columns to account for the increased light output caused by the tie bar elimination. This compensation is made by the reduction of the length of the penultimate apertures in the even numbered columns and by the consistent placement of a tie bar at a fixed distance from the array border in the even numbered columns.

In a tube having a 27 inch (68 cm) diagonal viewing screen, the tie bar width (on the side of the mask facing the gun) at the last tie bar in the even numbered columns, which priorly ranged from about 4.8 mils near the ends of the minor axis to 5.9 mils at the corners of the mask, was reduced to 4.3 mils, and the pitch for the last tie bars was reduced by 20 percent, resulting in the shorter penultimate apertures in the even numbered columns.

In making the improved shadow mask, a flat sheet of metal is coated on both sides with a photoresist material. The coated metal sheet is then exposed through photomasters that contain the aperture patterns for each side of the mask. Thereafter, the photoresist material is developed, and the photoresist at the locations of the intended apertures is washed away. Then, the metal sheet is etched from both sides, to form the apertures. The aperture pattern for the gun side of the mask consists of smaller aperture shapes than does the aperture pattern for the screen side of the mask. Both of these aperture patterns are shown superposed on each other in FIG. 5. In FIG. 5, the aperture patterns for columns 0 and 1 are shown at the upper array border. The larger areas 48 represent the aperture patterns for the screen side of the mask, and the smaller areas 49 represent the aperture patterns for the gun side of the mask. The aperture pattern for the screen side of the mask is continued beyond the array border 80, but a tie bar is inserted at the border on the gun side of the mask, so that all of the ultimate aperture patterns for the gun side of the mask end exactly at the array border. Because these tie bars exist on the gun side at the array border, the etched apertures end exactly at the array border for all columns.

What is claimed is:

1. In a color picture tube having a shadow mask mounted therein, said mask having a rectangular periphery with two long sides and two short sides, a major axis which passes through the center of said mask and parallels said long sides and a minor axis which passes through the center of said mask and parallels said short sides, and said mask having an aperture array including slit-shaped apertures aligned in columns that essentially parallel said minor axis and end at a border of the aperture array, adjacent apertures in each column being separated by tie bars in said mask, the tie bars in one column being offset in the longitudinal direction, paralleling the minor axis, from the tie bars in each adjacent column, and the spacing between tie bars in a column being the tie bar pitch at a location on the mask, the improvement comprising a first set of columns, comprising every other column, having increased tie bar pitch at the ultimate end apertures, as compared to the tie bar pitch at the penultimate apertures in each of the columns, a second set of columns, comprising every other column not in said first set, having decreased tie bar pitch at the ultimate end apertures, as compared to the tie bar pitch at the penultimate apertures in each of the columns, the last tie bars before the ends of the aperture columns in said second set being shorter than the next to the last tie bars thereof measured in the longitudinal direction of the columns, and the ultimate apertures at the ends of all of the aperture columns ending on a smooth border line.

* * * * *